US005833501A

United States Patent [19]

Jones

[11] Patent Number: 5,833,501

[45] Date of Patent: Nov. 10, 1998

[54] CAVITATION CONTROL FOR MARINE PROPULSION SYSTEM

[75] Inventor: James R. Jones, Neosho, Wis.

[73] Assignee: Brunswick Corporation, Lake Forest, Ill.

[21] Appl. No.: 892,921

[22] Filed: Jul. 15, 1997

[51] Int. Cl.[6] ..... B63H 11/00

[52] U.S. Cl. ..... 440/1; 440/38; 440/47

[58] Field of Search ..... 440/1, 38, 47, 440/66

[56] References Cited

U.S. PATENT DOCUMENTS

| | | | |
|---|---|---|---|
| 5,190,487 | 3/1993 | Fukui | 440/1 |
| 5,405,276 | 4/1995 | Kato | 440/38 |
| 5,613,887 | 3/1997 | Kobayashi | 440/47 |

*Primary Examiner*—Sherman Basinger
*Attorney, Agent, or Firm*—Andrus, Sceales, Starke & Sawall

[57] ABSTRACT

A jet drive cavitation control system briefly limits engine output power to prevent the onset of impeller cavitation when pressure upstream of the impeller indicates the likelihood of imminent impeller cavitation. The system uses a pressure sensor to sense water pressure, preferably immediately upstream of the impeller. The pressure sensor generates a signal that is transmitted to an electronic controller which controls the operation of the internal combustion engine that powers the jet drive. A threshold cavitation water pressure value is preselected at a point before the onset of impeller cavitation is likely. When the measured water pressure drops to or below the threshold cavitation water pressure value, the electronic controller immediately limits engine output to prevent impeller cavitation. Engine power output can be limited in any number of ways, for example, clipping spark plug ignition, retarding spark plug ignition, limiting throttle, limiting the amount of air supplied to the engine, limiting the amount of fuel supplied to the engine, adding water to the exhaust stream or modifying the configuration or operation of exhaust port valves, etc.

14 Claims, 2 Drawing Sheets

CAVITATION CONTROL FOR MARINE PROPULSION SYSTEM

FIELD OF THE INVENTION

The invention relates to cavitation control for marine propulsion systems. The invention is especially well-suited for minimizing impeller cavitation in marine jet drives.

BACKGROUND OF THE INVENTION

Marine jet drives are used in many marine applications, including propulsion for personal watercraft and jet boats. Jet drives for watercraft typically have an engine driven jet pump located within a duct in the hull of the watercraft. An inlet opening for the duct is positioned on the underside of the watercraft. The jet pump generally consists of an impeller and a stator located within the duct followed by a nozzle. A jet of water exits rearward of the watercraft to propel the watercraft. The impeller is driven by the engine to rotate within a wear ring. The rotating impeller provides thrust energy to the water flowing through the jet drive. The water then flows through the stator and the nozzle before exiting rearward through a generally tubular rudder than can be rotated to steer the watercraft.

When accelerating at low speeds, water pressure in the duct immediately upstream of the impeller can drop significantly, thus contributing to impeller cavitation. Impeller cavitation is not normally a problem at medium or high watercraft speeds (even during acceleration) because water ram pressure in the duct against the impeller is significant. If cavitation occurs, the jet pump unloads the engine, which in turn causes the impeller to rotate at a higher rate and the cavitation worsens. If the impeller is fully cavitated and the engine is fully unloaded, the operator of the watercraft must normally slow the engine to idle to alleviate the cavitation. In extreme cases, impeller cavitation can cause damage to mechanical parts of the jet drive. Because watercraft are operated rigorously and under various operating conditions, it is difficult to predict the onset of impeller cavitation based merely on engine rpm and throttle position. This can also be true in other marine applications, e.g. jet boats.

In order to eliminate the likelihood of impeller cavitation during acceleration at low speeds, marine jet drives are designed especially to minimize cavitation during acceleration at low speeds. For instance, the shape of the jet drive duct and the blade angle of the impellers are often selected to minimize impeller cavitation during low speed acceleration. However, such design configurations compromise jet drive performance at high speeds.

The likelihood of impeller cavitation during low speed acceleration is higher with larger watercraft, and is also higher when more powerful engines are used. Impeller cavitation therefore restricts the use of jet drives in larger watercraft, and in watercraft having more powerful engines.

SUMMARY OF THE INVENTION

The invention is a cavitation control system that is especially well-suited for use on jet-propelled watercraft. The system uses a pressure sensor to monitor water pressure upstream of the impeller, preferably immediately upstream of the impeller. In accordance with the invention, engine output power is limited briefly to prevent impeller cavitation when the measured water pressure indicates that the onset of cavitation would otherwise be likely.

The pressure sensor generates a water pressure signal that is preferably transmitted to an electronic controller which controls the operation of the internal combustion engine that powers the jet drive. The priority of the electronic control unit is to not limit engine output power unless the measured water pressure drops to or below a threshold cavitation water pressure value. The threshold water pressure value is preferably preselected at a pressure value slightly above the onset of impeller cavitation. Once the measured water pressure drops to or below the preselected water pressure value, the electronic controller immediately limits engine output to prevent impeller cavitation. Typically, engine output power need not be limited for more than approximately one-half second. Engine power output can be limited in any number of ways (for example, clipping spark plug ignition, retarding ignition timing advance, adding water to exhaust stream, modifying exhaust valve operation or configuration, limiting throttle, limiting the amount of air supplied to the engine, limiting the amount of fuel supplied to the engine), but clipping spark plug ignition is preferred.

Inasmuch as damaged impellers normally cavitate at lower speeds than undamaged impellers, it may be desirable to include means to automatically modify the threshold cavitation water pressure value after the system detects that impeller cavitation has occurred previously. One way to identify impeller cavitation is to monitor impeller rpm during acceleration at low speeds (e.g. sharp rises in impeller rpm indicates cavitation), although other methods may be employed in accordance with the invention.

One of the primary advantages of the invention is that the likelihood of impeller cavitation is detected accurately and shortly before the onset of actual impeller cavitation. Therefore, it is not necessary to limit engine output power for an excessively long period of time to prevent cavitation. This is possible because, in accordance with the preferred embodiment of the invention, water pressure is measured directly and immediately upstream of the rotating impeller, and the likelihood of imminent cavitation depends on the instantaneous water pressure at this location. The pressure sensor is preferably mounted to measure the pressure of water flowing through the wear ring in which the impeller rotates immediately upstream of the impeller. In addition, tests have shown that the most active pressure fluctuations during jet drive operation occur at the bottom of the wear ring. Therefore, placement of the pressure sensor through the bottom of the wear ring provides the greatest resolution for the pressure measurement.

An impeller cavitation control system in accordance with the invention is practical and eliminates the need to compromise jet drive design to accommodate low speed acceleration. Jet drives can therefore be designed to better optimize high speed performance, while using a cavitation control system in accordance with the invention to eliminate impeller cavitation during acceleration at low speeds. Further, by implementing the invention, engines having higher power outputs can be used to power jet propelled watercraft without having to compromise system performance to account for impeller cavitation difficulties.

Other features and advantages of the invention may be apparent to those skilled in the art upon inspecting the following drawings and description thereof.

DETAILED DESCRIPTION OF THE DRAWINGS

Figure 1:
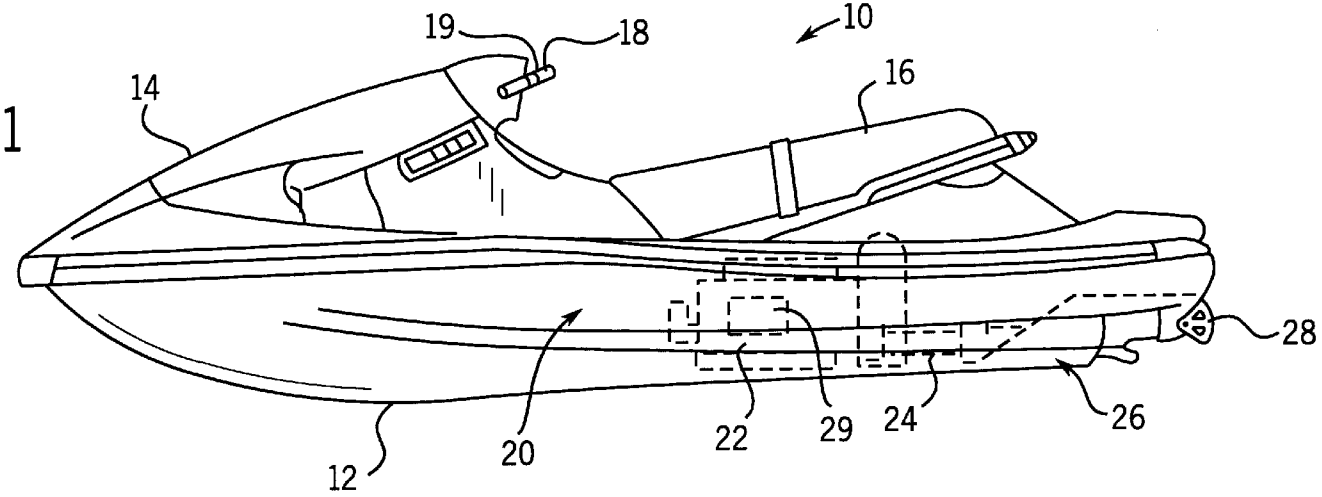
FIG. 1 is a schematic drawing of a personal watercraft.

FIG. 1 shows a personal watercraft 10. As previously mentioned, the invention has particular utility in small personal watercraft like the watercraft 10 depicted in FIG. 1, however, the application of the invention is not limited thereto.

The personal watercraft 10 has a hull 12 and a deck 14, both preferably made of fiber reinforced plastic. A driver and/or passenger riding on the watercraft 10 straddles the seat 16. The driver steers the watercraft 10 using a steering assembly 18 located forward of the seat 16. A throttle actuator 19 is normally mounted on the grip for the steering assembly 18.

An engine compartment 20 is located between the hull 12 and the deck 14. A gasoline fueled internal combustion engine 22 is located within the engine compartment 20. The engine has an output shaft 23, FIG. 2, that is coupled via coupler 24 to a jet pump located rearward of the engine 22 generally in the vicinity of arrow 26.

An electronic control unit 29 is provided within the engine compartment 20. The throttle actuator 19 actuates a throttle linkage, or communicates with the electronic control unit 29 as is known in the art, to adjust the engine throttle position in accordance with the position of the actuator 19. The electronic control unit 29 controls the operation of the engine 22. If the engine 22 is a carbureted engine, the electronic control unit 29 controls the timing for the spark plug ignition system. If the engine 22 is a fuel injected engine, the electronic controller not only controls timing for the spark plug ignition system, but also controls the timing and amount of fuel supplied to the engine.

Figure 2:
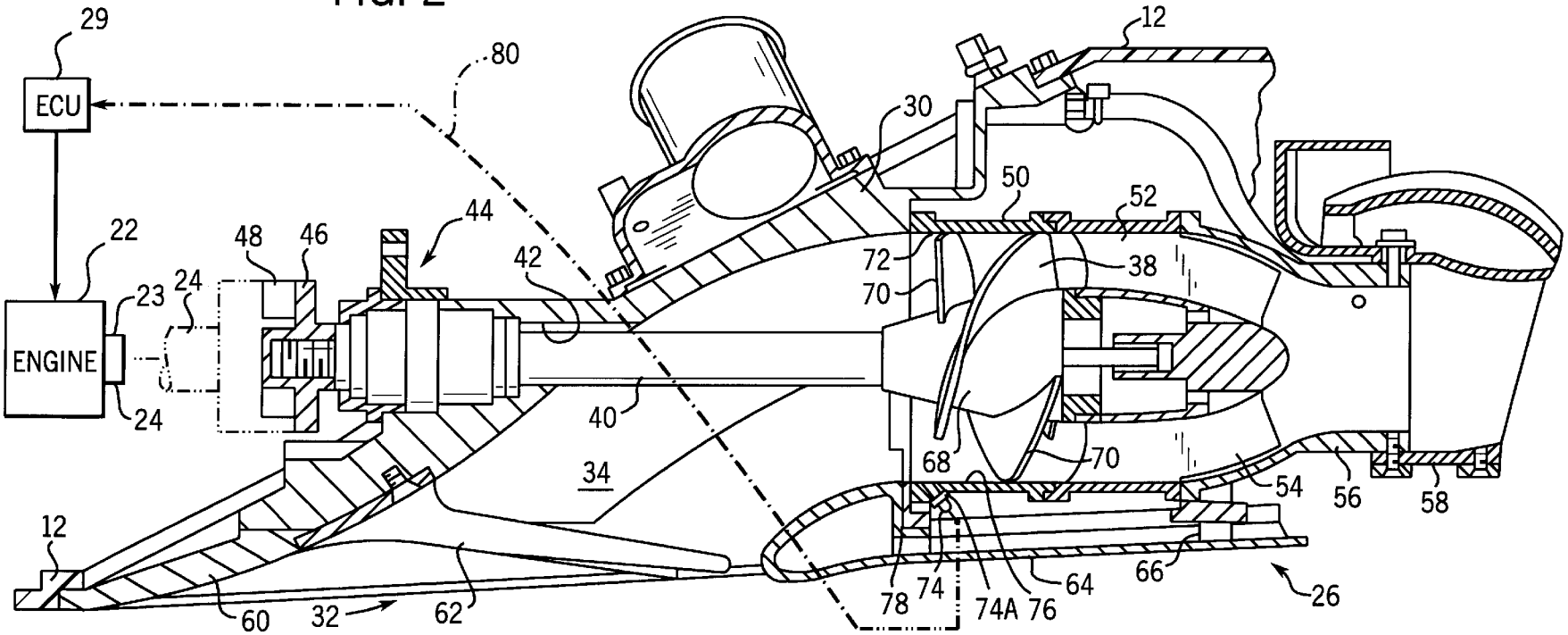
FIG. 2 is a detailed view of a personal watercraft jet drive implementing a jet drive cavitation control system in accordance with the invention.

FIG. 2 shows a jet pump 26 implementing an impeller cavitation control system as in accordance with the invention. The pump 26 includes an intake housing 30 that is attached to the hull 12. The intake housing 30 has an inlet opening 32 that provides a path for sea water to flow into an intake duct 34 located within the intake housing 30. Sea water flows upward and rearward through the intake duct 34 to an impeller 38. The impeller 38 is rotatably driven by an impeller drive shaft 40. The impeller drive shaft 40 passes through an impeller drive shaft opening 42 in the intake housing 30, and is coupled to the engine Output 23 or crankshaft shaft via coupler 24. As the impeller shaft 40 passes through the intake housing 30, the impeller shaft 40 is supported by a sealed bearing assembly 44. The preferred intake housing 30 as well as the preferred sealed bearing assembly 44 is described in detail in copending patent application Ser. No. 08/710,868, entitled "Intake Housing For Personal Watercraft", by James R. Jones, now U.S. Pat. No. 5,713,768, issued on Feb. 3, 1998, which is assigned to the assignee of the present application.

External to the intake housing 30, coupling head 46 is threaded onto the impeller drive shaft 40. The impeller coupling head 46 is preferably driven by the coupler 24 through an elastomeric member 48, although other coupling techniques can be used in accordance with the invention. The preferred coupler 24, elastomeric member 48, and impeller coupling head 46 are disclosed in detail in copending patent application Ser. No. 08/735,325, entitled "Engine Drive Shaft Coupler For Personal Watercraft", by Jerry Hale, now U.S. Pat. No. 5,720,638, issued on Feb. 24, 1998, which is assigned to the assignee of the present application.

The impeller 38 rotates within a wear ring 50 to accelerate sea water flowing through the jet pump 26. A stator 52 is located rearward of the impeller 38 and the wear ring 50. The stator 52 has several stationary vanes 54, preferably seven (7) vanes, to remove swirl from the accelerated sea water. After the sea water exits the stator 52, the water flows through a nozzle 56. As used herein, the term "jet drive duct" refers to the water flow passage defined by the combination of the intake duct 34, the wear ring 50, the stator 52, and the nozzle 56. The preferred construction of the stator 52 and the nozzle 56 is described in detail in copending U.S. patent application Ser. No. 08/710,869, entitled "Stator And Nozzle Assembly For Jet Propelled Personal Watercraft", by James R. Jones, now U.S. Pat. No. 5,713,769, issued on Feb. 3, 1998, which is assigned to the assignee of the present application.

Sea water exiting the nozzle 56 is directed by rotating tubular rudder 58 about a vertical axis to steer the personal watercraft 10. The reverse gate 28 is preferably mounted to the nozzle 56 along a horizontal axis. Alternatively, the reverse gate 28 can be mounted to a trimming gimbal along a horizontal axis. The preferred reverse gate mechanism is described in detail in copending patent application Ser. No. 08/783,440, entitled "Reverse Gate For Personal Watercraft", by James R. Jones, Peter P. Grinwald and Richard P. Christians, now U.S. Pat. No. 5,752,864, issued on May 19, 1998, which is assigned to the assignee of the present application.

An inlet adapter plate 60 is connected to the intake housing 30 upstream of the intake duct 34 to adapt intake housing 30 to the hull 12 on the underside of the watercraft 10. A tine assembly 62 has a plurality of tines that extend rearward from the inlet adapter 60 to cover the inlet opening 32. A ride plate 64 is mounted to the inlet adapter 60 rearward of the inlet opening 32. The ride plate 64 covers the area rearward of the inlet opening 32 to the transom of the watercraft 10 so that the pump components are not exposed below the watercraft 10. The ride plate 64 is supported in part by a depending boss 66 on the nozzle 56. The preferred inlet adapter system, including the inlet adapter plate 60, the tine assembly 62, and the ride plate 64, are disclosed in detail in copending patent application Ser. No. 08/717,915, entitled "Inlet Adapter For A Personal Watercraft", by James R. Jones, now U.S. Pat. No. 5,700,160 issued on Dec. 23, 1997, which is assigned to the assignee of the present application.

The impeller 38 has a hub 68, and blades 70 which extend outward from the impeller hub 68. Preferably, the impeller 38 has three or four blades 70. The impeller blades 70 should be equally spaced and the impeller 38 should be balanced. The impeller hub 68 has an outer surface that diverges as the surface extends rearward. The impeller blades 70 angle rearward as the blades 70 extend partially around the hub 38. Each blade 70 typically extends more than one-quarter around the hub 38. An outer edge 72 of each impeller blade 70 is in close proximity to the inner surface of the wear ring 50. Both the impeller 38 and the wear ring 50 are preferably made of stainless steel. The preferred method of mounting the impeller 38 to the impeller shaft 40 is described in detail in copending patent application Ser. No. 08/719,621, entitled "Impeller Mounting System For A Personal Watercraft", by James R. Jones, now U.S. Pat. No. 5,759,074, issued on Jun. 2, 1998, which is assigned to the assignee of the present application.

When the watercraft 10 is accelerating at low speeds, the pressure in the jet drive duct drops as the impeller 38 rotation speed increases to accelerate the watercraft 10. As the watercraft 10 speed increases, water ram pressure begins to counteract the pressure drop upstream of the impeller 38 caused by the accelerating impeller 38. Impeller cavitation is possible when the impeller 38 is rotating at high rates as the pressure drop in the duct immediately upstream of the impeller 38 peaks. Thereafter, impeller cavitation is unlikely.

In accordance with the invention, a pressure sensor 74 measures the water pressure of water flowing through the jet drive duct (i.e. the intake duct 34 and the wear ring 50) immediately upstream of the impeller 38. The pressure sensor 74 is preferably a mechanically actuated sensor including a diaphragm 74*a*. The bottom wall 76 of the wear ring 50 contains a pressure sensing access hole 78 therethrough. Various fittings or the like may be used to install the access hole 78, however, it is preferred that the access hole 78 be a cylindrical hole through wear ring 50 having a diameter of approximately 0.125 inches. The diaphragm 74*a* for the mechanical pressure sensor 74 is exposed to water flowing through the jet drive duct immediately upstream of the impeller 38 via the access hole 78. The pressure sensor 74 generates a water pressure signal in response to the measured water pressure. The water pressure signal is transmitted, line 80, to the electronic control unit 29.

Figure 3:
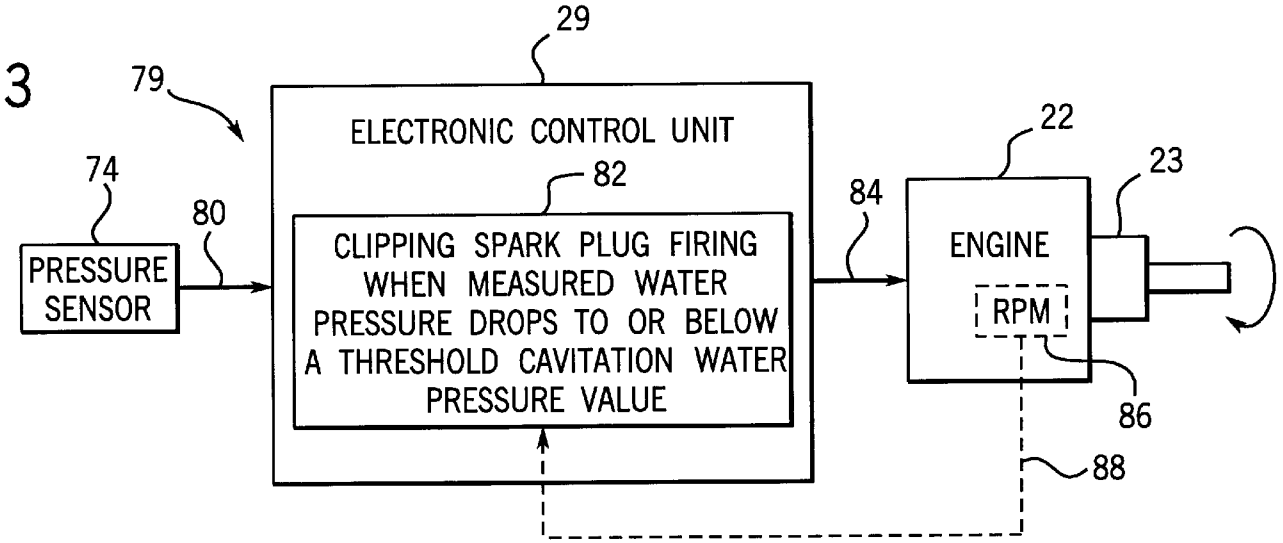
FIG. 3 is a flowchart illustrating the preferred means in which an electronic control unit for the personal watercraft limits engine output power to prevent the onset of impeller cavitation.

The electronic control unit 29 is programmed to immediately limit engine output power when the water pressure measured by the pressure sensor 74 indicates that the onset of imminent impeller cavitation is probable unless engine power is limited. FIG. 3 schematically illustrates the operation of the cavitation control system 79 to limit engine output power and prevent impeller cavitation. The water pressure signal in line 80 from pressure sensor 74 inputs the electronic control unit 29 which is preferably programmed to clip ignition spark plug firing when the measured water pressure drops to or below a threshold cavitation water pressure, block 82. The electronic control unit 29 transmits control signals, line 84, to the engine ignition coils which fire the engine spark plugs. Clipping ignition spark plug firing is the preferred way of limiting engine output power because it is important that engine output power be limited immediately upon detection that the water pressure has dropped to or below the threshold cavitation water pressure value. Typically, it is not necessary to clip spark plug firing for more than about one-half second to control water pressure upstream of the impeller 38 and prevent cavitation.

Other methods of immediately limiting engine power output besides clipping ignition spark plug firing may be suitable or even more appropriate depending on the type of engine 22 used to power the watercraft 10. For instance, spark ignition coil be retarded in some engines to quickly limit engine output power. Also, the power output in some engines can be reduced by adding water into the exhaust stream, or by adjusting the timing of exhaust valves and/or configuration of exhaust ports. Further, less preferred methods of limiting engine output power such as limiting engine throttle position, limiting the amount of air supplied to the engine, or limiting the amount of fuel supplied to the engine may be suitable to immediately limit engine output power in some engines.

The priority of the electronic control unit 29 is to operate the engine as normal without accommodating the cavitation control system 79, unless the water pressure measured by the pressure sensor 74 drops to or below the threshold cavitation water pressure value. Once the water pressure measured by the pressure sensor 74 drops to or below the threshold cavitation water pressure value, the electronic control unit 29 is triggered to immediately limit engine output power until the water pressure measured by the pressure sensor 74 recovers.

The threshold cavitation water pressure is programmed into the electronic control unit 29 and is selected at a value slightly above the onset of impeller cavitation. The specific value of the threshold cavitation water pressure value depends on the configuration of the jet drive including the configuration of the impeller 38. The threshold cavitation water pressure value also depends on other factors including the power output of the engine 22, boat size and the like. For the embodiment of the invention illustrated m FIGS. 1 and 2, the threshold cavitation water pressure value is in the range of 7.5 to 8.5 psi below the nominal water pressure in the jet pump duct when the watercraft 10 is at rest.

FIG. 3 also depicts an engine crankshaft rpm sensor 86. The crankshaft rpm sensor 86 is preferably a crankshaft position sensor as is known in the art. The rpm sensor 86 monitors the revolution rate of the crankshaft 23, and thus provides a measurement of the revolution rate of the impeller shaft 40. The rpm sensor 86 generates an rpm signal that is transmitted through line 88 to the electronic control unit 29. Based on the rpm signal, the electronic control unit 29 determines whether the impeller 38 has cavitated. If the program in the electronic control unit 29 determines that the impeller 38 has previously cavitated, the electronic control unit 29 automatically modifies the threshold cavitation water pressure value so that future impeller cavitation is unlikely. The ability to modify the threshold cavitation water pressure value is advantageous because damaged impellers 38 are more likely to cavitate than undamaged impellers 38.

The pressure sensing access hole 78 through the wear ring 50 is located upstream of the location where the outer edge 72 of the impeller blades 70 sweep around the inside surface 76 of the wear ring 50. It is desirable that the access hole 78 be as close to the upstream edge of the impeller 38 as possible. Locating the access hole 78 farther upstream in the jet pump duct, such as locating the access hole 78 through the wall of the intake housing 30 into the intake duct 34, may be suitable in some applications but is less likely to provide an accurate prediction of imminent impeller cavitation. Locating the access hole 78 in the wear ring 50 at the bottom of the wear ring 50 is desirable because that location provides the largest and most accurate water pressure fluctuations. However, depending on the hydrodynamics of the specific jet pump 26, it may be desirable to locate the water pressure access hole 78 through the top or the side of the wear ring. Placing the access hole 78 through the top or the side of the wear ring 50 may be advantageous in some systems because there may be less chance for the access hole 78 to fill with sand or the like.

The foregoing description is a description of the preferred embodiment of the invention as installed in a personal watercraft. It should be readily apparent to those skilled in the art that the invention has utility to prevent cavitation in other types of marine propulsion systems. For instance, the invention may be used in marine jet drives for larger watercraft, in jet drives having vertically mounted impellers, in marine drives having propellers, and in highbred marine propulsion systems. It is recognized that other alternatives, modifications and equivalents of the invention may also be possible in accordance with the true spirit of the invention. Such modifications, alternatives and equivalents should be considered to fall within the scope of the following claims.

I claim:

1. A jet propelled watercraft comprising:

an engine;

a watercraft jet drive including a duct and an impeller located within the duct;

a water inlet on the underside of the watercraft that provides an opening for water to flow through the duct to the impeller, wherein the impeller is driven by the engine to provide thrust energy to the flow of water through the duct;

an outlet that allows water to flow from the jet drive rearward of the watercraft after the impeller has provided thrust energy to the flow of water through the duct;

a pressure sensor that senses water pressure in the duct upstream of the impeller and generates a water pressure signal in response thereto; and an electronic controller that controls the operation of the engine and receives the water pressure signal generated by the pressure sensor, wherein the electronic controller limits engine output power to reduce impeller cavitation based on the water pressure signal;

wherein the jet drive duct comprises in part a wear ring surrounding the impeller, the wear ring containing an access hole through a wall of the wear ring and the pressure sensor is mounted in fluid communication with the access hole to expose the pressure sensor to water passing through the duct.

2. A jet propelled watercraft as recited in claim 1 wherein the access hole is through a bottom surface of the wear ring.

3. A jet propelled watercraft as recited in claim 1 wherein the pressure sensor is a mechanically actuated sensor including a diaphragm.

4. A jet propelled watercraft comprising:

an engine;

a watercraft jet drive including a duct, an impeller located within the duct, and an impeller shaft driven by the engine to which the impeller is mounted;

a water inlet on the underside of the watercraft that provides an opening for water to flow through the duct to the impeller, wherein the impeller is driven by the engine to provide thrust energy to the flow of water through the duct;

an outlet that allows water to flow from the jet drive rearward of the watercraft after the impeller has provided thrust energy to the flow of water through the duct;

a pressure sensor that senses water pressure in the duct upstream of the impeller and generates a water pressure signal in response thereto;

an rpm sensor that monitors the revolution rate of the impeller shaft and generates an rpm signal in response thereto; and an electronic controller that controls the operation of the engine and receives the water pressure signal generated by the pressure sensor and the rpm signal;

wherein the electronic controller is programmed to immediately limit engine output power when water pressure sensed by the pressure sensor drops to or below a threshold cavitation water pressure; and wherein the electronic controller includes means for determining whether the impeller has cavitated based on the rpm signal and also includes means for modifying the threshold cavitation water pressure value if said cavitation determining means determines that the impeller has previously cavitated.

5. A jet propelled watercraft as recited in claim 4 wherein the rpm signal directly measures revolution of an engine crankshaft to monitor the revolution rate of the impeller shaft.

6. A method of preventing impeller cavitation in a jet propelled watercraft comprising the steps of:

using an internal combustion engine to rotate an impeller located within a wear ring in a jet drive duct for the watercraft;

drawing water through a water inlet into the duct with the rotating impeller;

providing thrust energy to the flow of water through the duct by rotating the impeller;

after providing thrust energy to the flow of water through the duct, discharging the flow of water from the duct rearward of the watercraft to propel the watercraft;

accelerating the watercraft by increasing the power output of the internal combustion engine;

providing a water pressure access hole through the wear ring into the jet drive duct upstream of the impeller for a pressure sensor;

measuring the water pressure in the duct upstream of the impeller with the pressure sensor; and limiting the power output of the internal combustion engine when water pressure in the duct upstream of the impeller drops to or below a threshold cavitation water pressure value.

7. A method as recited in claim 6 wherein the power output of the internal combustion engine is limited by clipping cylinder spark ignition.

8. A method as recited in claim 6 wherein the power output of the internal combustion engine is limited by retarded cylinder spark ignition timing.

9. A method as recited in claim 6 wherein the power output of the internal combustion engine is limited by limiting an engine throttle.

10. A method as recited in claim 6 wherein the power output of the internal combustion engine is limited by limiting the amount of air supplied to the engine.

11. A method as recited in claim 6 wherein the power output of the internal combustion engine is limited by limiting the amount of fuel supplied to the engine.

12. A method as recited in claim 6 wherein the power output of the internal combustion engine is limited by adding water into the engine exhaust stream.

13. A method as recited in claim 6 wherein the power output of the internal combustion engine is limited by advancing the opening of cylinder exhaust valves.

14. A method as recited in claim 6 wherein the power output of the internal combustion engine is limited by adjusting the configuration of exhaust port valves.

* * * * *